US009822470B2

(12) United States Patent
Manipatruni et al.

(10) Patent No.: US 9,822,470 B2
(45) Date of Patent: Nov. 21, 2017

(54) FLEXIBLE EMBEDDED INTERCONNECTS

(71) Applicant: INTEL CORPORATION, Santa Clara, CA (US)

(72) Inventors: Sasikanth Manipatruni, Hillsboro, OR (US); Brian S. Doyle, Portland, OR (US); Shawna M. Liff, Gilbert, AZ (US); Vivek K. Singh, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 649 days.

(21) Appl. No.: 13/714,990

(22) Filed: Dec. 14, 2012

(65) Prior Publication Data

US 2014/0170919 A1 Jun. 19, 2014

(51) Int. Cl.

| | |
|---|---|
| ***D03D 1/00*** | (2006.01) |
| ***H01B 7/04*** | (2006.01) |
| ***D02G 3/44*** | (2006.01) |
| ***D04H 3/00*** | (2012.01) |
| ***D01D 5/00*** | (2006.01) |
| ***D01D 5/34*** | (2006.01) |
| ***B21C 37/04*** | (2006.01) |
| ***B21C 23/08*** | (2006.01) |
| ***D04H 1/4266*** | (2012.01) |
| ***D04H 1/4382*** | (2012.01) |

(52) U.S. Cl.

CPC ..... *D03D 1/0088* (2013.01); *B21C 23/08* (2013.01); *B21C 37/042* (2013.01); *B21C 37/047* (2013.01); *D01D 5/00* (2013.01); *D01D 5/34* (2013.01); *D02G 3/441* (2013.01); *D04H 1/4266* (2013.01); *D04H 1/4382* (2013.01); *D04H 3/00* (2013.01); *D10B 2401/16* (2013.01); *D10B 2401/18* (2013.01); *Y10T 442/3057* (2015.04); *Y10T 442/603* (2015.04)

(58) Field of Classification Search

CPC ..... D03D 1/0088; B21C 3/00; H01B 7/04
See application file for complete search history.

(56) References Cited

U.S. PATENT DOCUMENTS

| | | | | |
|---|---|---|---|---|
| 3,386,476 | A * | 6/1968 | Starkweather, Jr. | .... B32B 27/00 138/144 |
| 4,457,973 | A | 7/1984 | Matsui et al. | |
| 4,491,845 | A | 1/1985 | Rothenberg | |
| 4,678,274 | A | 7/1987 | Fuller | |
| 4,930,863 | A | 6/1990 | Croitoriu et al. | |

(Continued)

FOREIGN PATENT DOCUMENTS

| | | |
|---|---|---|
| WO | 0124596 A1 | 4/2001 |
| WO | 2010/067283 A1 | 6/2010 |

OTHER PUBLICATIONS

"Piezoluminescence from a ferroelectric polymer and quartz" Journal of Luminescence 75, 295-299, 1997 (Reynolds).*

(Continued)

*Primary Examiner* — Jennifer Chriss
*Assistant Examiner* — Ricardo Lopez
(74) *Attorney, Agent, or Firm* — Finch & Maloney PLLC

(57) ABSTRACT

Flexible electronically functional fibers are described that allow for the placement of electronic functionality in traditional fabrics. The fibers can be interwoven with natural fibers to produce electrically functional fabrics and devices that can retain their original appearance.

32 Claims, 10 Drawing Sheets

(56) References Cited

U.S. PATENT DOCUMENTS

| | | | | |
|---|---|---|---|---|
| 5,574,470 | A | 11/1996 | de Vall | |
| 5,827,797 | A * | 10/1998 | Cass | C04B 35/62227 264/28 |
| 6,158,884 | A | 12/2000 | Lebby et al. | |
| 6,210,771 | B1 | 4/2001 | Post et al. | |
| 6,321,630 | B1 * | 11/2001 | Woodall et al. | 89/1.13 |
| 6,329,915 | B1 | 12/2001 | Brady et al. | |
| 6,329,917 | B1 | 12/2001 | Leonard | |
| 6,374,643 | B2 | 4/2002 | Orima | |
| 6,437,422 | B1 * | 8/2002 | Solomon et al. | 257/618 |
| 6,727,197 | B1 | 4/2004 | Wilson et al. | |
| 6,913,713 | B2 | 7/2005 | Chittibabu et al. | |
| 7,025,596 | B2 | 4/2006 | Zollo et al. | |
| 7,047,800 | B2 | 5/2006 | Thiesen et al. | |
| 7,974,075 | B2 | 7/2011 | Peng et al. | |
| 8,003,198 | B2 | 8/2011 | Park et al. | |
| 8,199,416 | B2 | 6/2012 | Mori | |
| 2003/0039843 | A1 * | 2/2003 | Johnson | C03C 17/002 428/432 |
| 2004/0057176 | A1 | 3/2004 | Dhawan et al. | |
| 2004/0115430 | A1 | 6/2004 | Leonard | |
| 2005/0275567 | A1 * | 12/2005 | DePue et al. | 341/32 |
| 2006/0289189 | A1 | 12/2006 | Aisenbrey | |
| 2007/0128437 | A1 * | 6/2007 | Wilderbeek | D01D 5/426 428/375 |
| 2009/0275826 | A1 * | 11/2009 | Enzerink | B32B 3/26 600/424 |
| 2009/0301565 | A1 * | 12/2009 | Curran et al. | 136/263 |
| 2011/0130636 | A1 * | 6/2011 | Daniel et al. | 600/301 |
| 2011/0290304 | A1 | 12/2011 | Daniel | |
| 2011/0301657 | A1 * | 12/2011 | Walsh | A61N 1/056 607/5 |
| 2011/0308077 | A1 * | 12/2011 | Shtein et al. | 29/825 |
| 2012/0019105 | A1 * | 1/2012 | Krohn | G01B 17/02 310/336 |
| 2012/0100355 | A1 | 4/2012 | Pham et al. | |
| 2013/0023172 | A1 | 1/2013 | Lee | |
| 2014/0170920 | A1 | 6/2014 | Manipatruni et al. | |

OTHER PUBLICATIONS

Measurement Specialities, "Piezo Film Sensors Technical Manual", Measurement Specialities, Inc., Sensor Products Division, 950 Forge Avenue, Norristown, P/N 1005663-1 Rev B, Apr. 2, 1999, 89 pages.

Lyon, France, "General Introduction to the Chemistry of Dyes", 1. Principles of Colour Chemistry, vol. 99, 2010, pp. 55-67.

Dong et al., "Piezo-Phototronic Effect of CdSe Nanowires", Materials Views, Advanced Materials, 2012, pp. 1-6.

Wang et al., "Packaging Effects on Reliability of Cu/Low-k Interconnects", IEEE Transactions on Device and Materials Reliability vol. 3, Issue No. 4, Dec. 2003, pp. 119-128.

International Search Report and Written Opinion received for Patent Application No. PCT/US2013/046868, dated Oct. 11, 2013, 14 pages.

International Search Report and Written Opinion received for Patent Application No. PCT/US2013/045913, dated Oct. 7, 2013, 16 pages.

Office Action received in U.S. Appl. No. 13/715,012, dated Mar. 23, 2015, 52 pages.

PCT International Preliminary Report on Patentability, received in PCT Application No. PCT/US2013/045913, dated Jun. 25, 2015, 9 pages.

PCT International Preliminary Report on Patentability, received in PCT Application No. PCT/US2013/046868, dated Jun. 25, 2015, 7 pages.

Final Office Action dated Nov. 18, 2015, received in U.S. Appl. No. 13/715,012, 41 pages.

Office Action received in Taiwan Patent Application No. 102143012, dated Jan. 26, 2016, 18 pages.

* cited by examiner

FLEXIBLE EMBEDDED INTERCONNECTS

BACKGROUND

Consumer demand for more portable and capable electronic devices has driven the development and production of smaller and more user-friendly devices. Users expect greater functionality out of even smaller devices and carry with them devices that exhibit functionality that was previously not available or only available in non-portable devices. Garments now include specialized pockets for phones, GPS devices and music players with built-in sleeves for routing cords for controllers or headsets.

As will be appreciated, the figures are not necessarily drawn to scale or intended to limit the claimed invention to the specific configurations shown. For instance, while some figures generally indicate straight lines, right angles, and smooth surfaces, an actual implementation of a transistor structure may have less than perfect straight lines, right angles, and some features may have surface topology or otherwise be non-smooth, given real world limitations of the processing equipment and techniques used. In short, the figures are provided merely to show example structures.

DETAILED DESCRIPTION

In one aspect, a fabric is provided that includes electronic functionality that can be used in clothing, footwear, upholstery and other applications where conventional woven and non-woven fabrics are used. The fabric may include flexible electrically functional fibers that impart electronic functionality to the fabric without adversely affecting the appearance and/or feel of the fabric. The flexible electrically functional fibers may be woven directly into a fabric, as is done with textile fibers. The flexible electrically functional fibers may incorporate conventional natural or synthetic fibers in order to blend in with other fibers that may be used to form the bulk of the fabric. The flexible electrically functional fibers may include coaxial layers of electronically active and inactive materials. The flexible electrically functional fibers may include specific electronic features and capabilities such as low resistance conductors, piezo resistant materials, piezo luminescent materials and high capacitance materials. By incorporating these flexible electrically functional fibers into fabrics, the fabrics can become functional electronic devices. For example, the fabrics may include circuits, switches, lights, controllers, sensors, antennas, transmitters and power supplies. The electronically functional fabrics can be used in finished goods such as clothing, footwear, outerwear, upholstery and recreational goods such as sporting goods, camping materials and boating equipment. The fabrics can provide a variety of new functionalities without affecting the aesthetics of the finished goods and in some cases may be indistinguishable from goods made out of conventional fabrics.

Functional Fibers

Figure 1A:
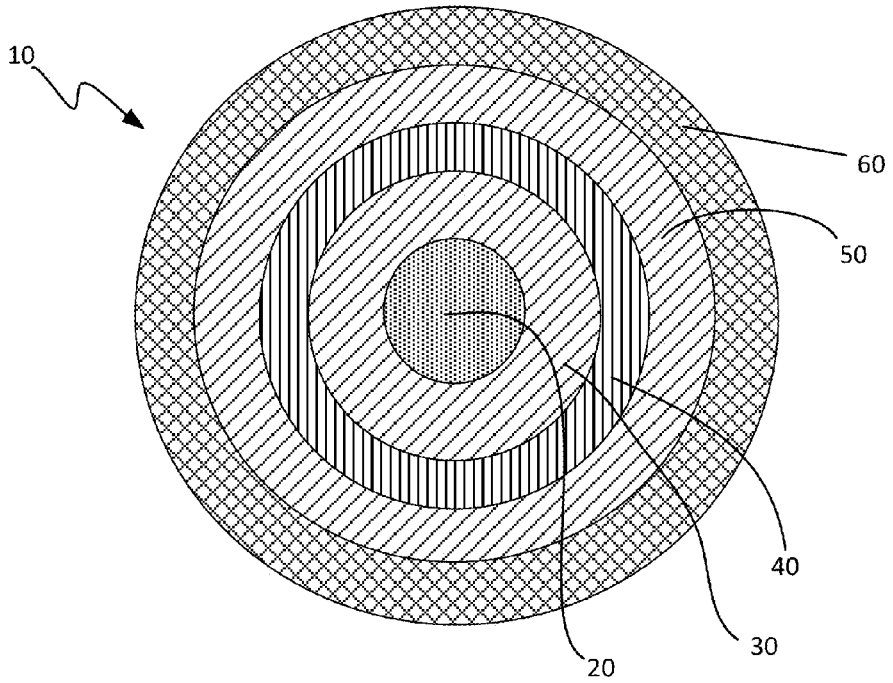
FIG. 1A provides a transverse cross sectional view of a fiber of one embodiment of the invention.
Figure 1B:
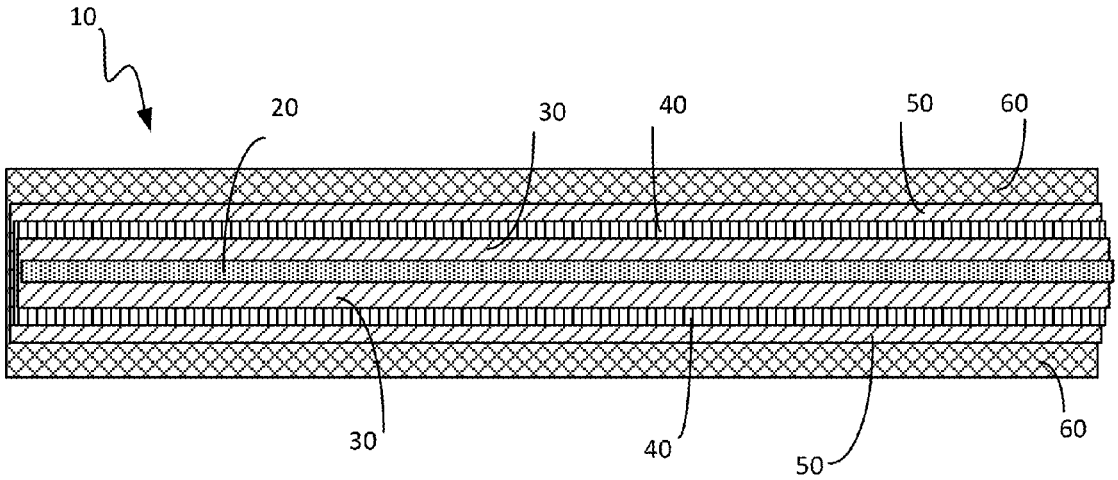
FIG. 1B is a longitudinal cross sectional view of the fiber of FIG. 1.

In one set of embodiments, a flexible electrically functional fiber is provided that can be woven into flexible substrates such as fabrics. As used herein, a flexible electrically functional fiber ("functional fiber" throughout) is a man-made fiber comprising at least three or more layers of different materials wherein the different materials exhibit different electrical characteristics. The functional fiber may include ordered embedded structures to provide low capacitance and low resistance for high speed interconnects. The functional fiber may include two or more coaxial layers that may be, for instance, either conductive or non-conductive. In many embodiments, multiple thin layers of material can provide greater flexibility than do fewer, thicker layers of material. As illustrated in the specific embodiment shown in cross-section views in FIGS. 1A and 1B, functional fiber 10 can include a core 20; a first conductive layer 30; an inner insulative layer 40; a second conductive layer 50; and an outer insulative layer 60.

Core 20 may be thin and flexible, providing for a functional fiber that can be woven into a fabric. The core may be, for example, substantially round in cross-section and may have an average diameter of, for example, from 10 nm to 100 μm, 10 nm to 10 μm, or 100 nm to 10 μm, in some embodiments. The diameter of the core may vary along its length by a factor of >2, >5 or >10. In other embodiments, the core may have a consistent diameter along its length that does not vary by more than, for example, 50%, 20%, 10% or 1%. The functional fiber may be easily bendable, similar to a natural or synthetic non-electrically functional fiber. For example, the functional fibers described herein may exhibit a natural bending radius of less than 2 mm, less than 1 mm or less than 0.5 mm. The natural bending radius of an electrically functional fiber is the radius of the smallest cylinder that the fiber can be wrapped around without losing its intended electrical capability. The flexibility of a functional fiber can also be mechanically evaluated similarly to the way textile fibers are evaluated for flexibility. For example, in some embodiments a functional fiber can exhibit a flexibility (I/MR) greater than (more flexible than) that of a nylon fiber having a diameter equal to, or 1.1×, 1.2×, 1.5×, 2.0× or 3.0× the diameter of the functional fiber. Core 20 may be made from conductive or non-conductive material and in the embodiment shown is non-conductive. The core can be made from a textile fiber. As used herein, a "textile fiber" is a natural or synthetic fiber conventionally used to make woven or non-woven textiles. Textile fibers typically do not exhibit electrical functionality although they may exhibit electrical properties. Example natural materials include plant fibers such as cotton, cellulose, flax and hemp as well as animal derived fibers such as wool and silk. Example synthetic materials include polymeric and non-polymeric materials. Example polymers may be polyolefins such as polyethylene and polypropylene and halogenated polymers such as polyvinylchloride. Additional example synthetics include those materials used in fibers and fabrics such as rayon, nylon, acrylic, polyester, aramid, carbon fiber and glass. In some embodiments the core may be void, providing a hollow core functional fiber. In other embodiments, the core may comprise or consist essentially of a fluid such as a liquid or gas at room temperature. A liquid core may be efficient at absorbing and transporting heat and may be a substance exhibiting a high specific heat, such as greater than 0.5 cal/g° C., greater than 0.80 cal/g° C., greater than 0.90 cal/g° C. or greater than 0.95 cal/g° C. Examples of appropriate liquids include aqueous compositions such as water and water/glycol mixtures. Non-aqueous examples include, for example, low toxicity, high flash point materials such as glycols, and vegetable oils. In an alternative set of embodiments, core 20 may comprise a gel or a foam that can be conductive or non-conductive.

Conductive layers 30 and 50 may be flexible, ductile and/or conductive and can comprise materials that exhibit resistivity values of, for instance, less than $10^{-2}$ Ω·m, less than $10^{-4}$ Ω·m, less than $10^{-5}$ Ω·m, less than $10^{-6}$ Ω·m, less than $10^{-7}$ Ω·m, less than $2.0\times10^{-8}$ Ω·m or less than $1.7\times10^{-8}$ Ω·m, in accordance with some embodiments. The conductive materials may be metallic or non-metallic and may include polymeric materials. To this end, any material having a suitable degree of conductivity for a given application can be used for the conductive layers 30 and 50. Example metals include, for example, silver, copper, gold, aluminum, platinum, lead and iron. The conductive material may also be an alloy or may be a doped metal. The conductive materials may be applied as a film using methods known for applying conductive films to substrates. If a polymer, the conductive material may include a dopant or additive such as iodine or carbon black. In some embodiments the conductive layer may be a translucent or transparent material. These materials include, for example, transparent conductive oxides (TCO) such as tin-doped indium-oxide, aluminum-doped zinc-oxide (AZO) and indium-doped cadmium-oxide. Transparent or translucent polymeric materials include, for example, polymers containing thiophenes such as poly(3,4-ethylenedioxythiophene) (PEDOT), PEDOT with poly(styrene sulfonate) (PSS) and poly(4,4-dioctylcyclopentadithiophene). In some embodiments, one or more conductive layers 30 and/or 50 can comprise or consist essentially of conductive foam or a conductive gel as these materials can provide, for example, both flexibility and conductivity.

In transverse cross-section, conductive layers 30 and 50 may be substantially circular and may have an average diameter of from 10 nm to 100 μm, 100 nm to 10 μm, or 100 nm to 100 μm, in some embodiments. The ratio of the diameters of first conductive layer 30 or second conductive layer 50 to core 20 may be, for example, greater than 1.5:1, greater than or equal to 3:1, greater than or equal to 5:1, greater than or equal to 10:1, greater than or equal to 50:1 or less than 100:1. The ratio of the diameter of second conductive layer 50 to that of first conductive layer 30 can be, for example, greater than or equal to 1.5:1, greater than or equal to 2:1, greater than or equal to 3:1, greater than or equal to 10:1, greater than or equal to 50:1 or less than 100:1. The wall thickness of each of conductive layers 30 and 50 may be, for example, less than 100 μm, less than 10 μm, less than 1 μm, less than 100 nm, less than 10 nm or greater than 1 nm.

The inner insulative layer 40 can include, for example, a low-k flexible dielectric material, or any other suitable dielectric material capable of providing the desired flexibility and insulative effect including high-k dielectrics as well as dielectric materials having a dielectric constant on par with silicon dioxide. The materials may exhibit a dielectric constant (k) of, for example, less than 3.9, less than 3.5 or less than 3.0, in some embodiments. The dielectric layer 40 may be substantially circular in cross-section and the ratio of the diameter of the layer compared to first conductive layer may be less than or equal to 3:1, less than or equal to 2:1, less than or equal to 1.5:1, less than or equal to 1.2:1 and may be greater than or equal to 1.01:1. Dielectric layer 40 can have a wall thickness of, for example, less than 100 μm, less than 10 μm, less than 1 μm, less than 100 nm, less than 10 nm, less than 5 nm or greater than or equal to 1 nm. Dielectric layer 40 can be made from materials including porous silicon dioxide and silicon dioxide doped with fluorine and/or carbon. Other example dielectric materials include polymer dielectrics including spin-on organic polymeric dielectrics such as hydrogen silsesquioxane (HSQ) and methyl silsesquioxane (MSQ), polyimide, polynorbornenes, benzocyclobutene, and PTFE. Additional example polymeric dielectrics may be made from cyclic carbosilanes. Examples of high-k dielectric materials include, for instance, hafnium oxide, hafnium silicon oxide, nitrided hafnium silicates, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate. The dielectric may be porous or non-porous. In general, porosity may be provisioned as a way of controlling the desired k-factor (increased porosity may be used to cause a decrease in the dielectric constant of the layer).

Outermost layer 60 may be flexible, ductile and/or electrically insulative. In some embodiments layer 60 may be either opaque, translucent or transparent. The layer can include a polymeric material, can consist essentially of a polymeric material or can be exclusively a polymeric material. Example polymers may include, for example, polyolefins such as polyethylene and polypropylene and halogenated polymers such as polyvinylchloride and PTFE. Additional example polymers include materials such as rayon, nylon, acrylic, polyester and aramid. Outer layer 60 may completely cover conductive layer 50 and may be substantially circular in cross-section. Layer 60 may have a wall thickness of, for example, less than 500 μm, less than 100 μm, less than 10 μm, less than 1 μm, less than 100 nm, less than 10 nm or greater than 1 nm, in some embodiments. Outer layer 60 may include natural materials for textural or aesthetic reasons. Outer layer 60 may also include additives such as pigments, dyes, antioxidants and/or UV inhibitors and may also include an additive for rendering the layer more compatible with dyes. Layer 60 may be treated, for example by ozone or another oxidizer, to improve compatibility with a dye or ink. In this manner, the functional fiber can be colored using methods similar to those used for conventional fibers. If the functional fiber is to be used in a fabric comprising natural fibers such as cotton, outer layer 60 of the functional fiber can be a hydrophilic material, such as rayon, which will accept many of the dyes used to color cotton. In this way, a fabric comprising both natural fibers and functional fibers can be dyed evenly, blending the functional fibers with the natural fibers in the fabric. In other embodiments, hydrophobic materials are preferred. Specific functional fiber colors can be used for identification or for aesthetic purposes when incorporated into fabrics. The outer layer 60 may protect the fiber from heat and moisture and can allow fabrics made using the fiber to be laundered without damaging the functionality of the fiber.

Figure 2A:
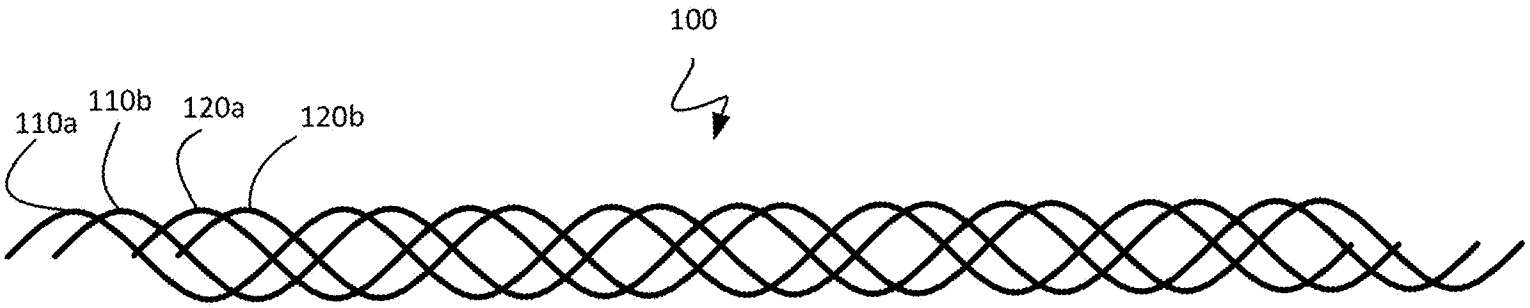
FIG. 2A illustrates an embodiment of the invention including two twisted pairs of fibers.
Figure 2B:
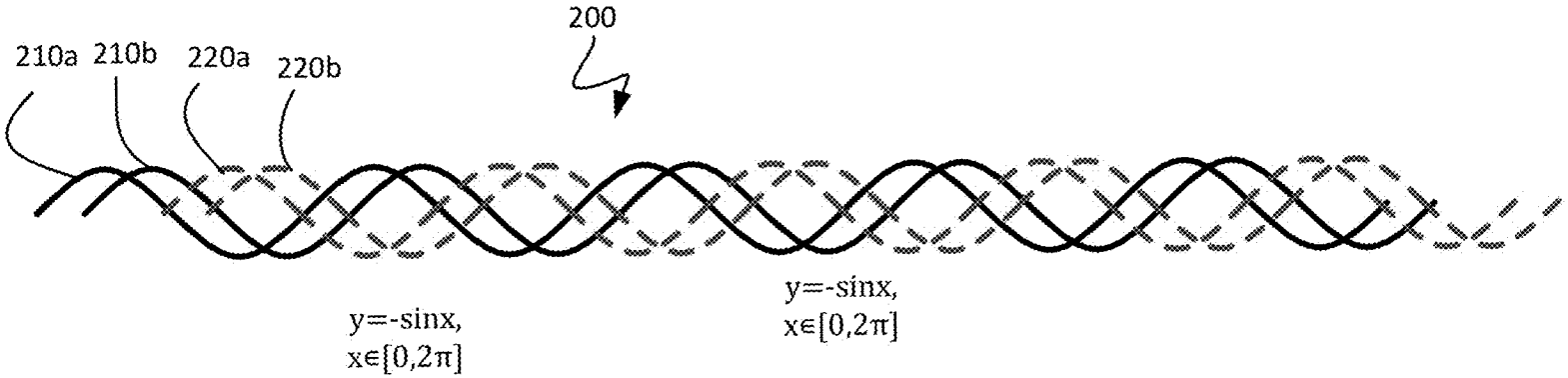
FIG. 2B illustrates an embodiment of the invention including a twisted pair of functional fibers and a twisted pair of textile fibers.

As illustrated in FIG. 2A, the functional fibers described herein can be used in twisted pair configurations, in accordance with some embodiments. The use of twisted pair configurations can help achieve low resistance while maintaining the high flexibility of the composite thread 100. For example, in one embodiment, multiple twisted pairs of contiguous interconnects connected in parallel can reduce series resistance. Twisted pair configurations may also be used to reduce crosstalk of signals traveling within the functional fibers. As used herein, a composite thread is a thread that includes more than one type of fiber. Although the illustration shows two twisted pairs 110*a*, 110*b* and 120*a*, 120*b*, any number of twisted pairs can be used together. For example, composite thread 100 may include one, two, three, four, five, six or more twisted pairs. FIG. 2B illustrates an embodiment of a hybrid composite thread 200. Hybrid composite thread 200 can include electrically functional pair 210*a* and 210*b* as well as textile fiber pair 220*a* and 220*b*. The ratio of electrically functional fibers to conventional fibers can vary and may depend on, for example, the amount of functionality or the amount of natural feel, look and texture that is desired for the hybrid thread 200. In other embodiments, short non-functional fibers such as cotton, wool or polyester threads may be mixed into the composite threads of FIGS. 2A and 2B. These short fibers may be positioned substantially transversely to the axis of composite thread 100 or 200. The short fibers may be held in place by retaining them between the individual functional fibers that make a twisted pair or between the pairs themselves. These transverse fibers may extend outwardly 2, 3, 5 or 10 times the diameter of the thread or fiber. Under the microscope these threads may appear as caterpillars or "pipe cleaners" with the ends of the non-functional fibers extending radially from the axis of thread 100 or thread 200. This configuration can provide for a unique textural or aesthetic appearance without stiffening the hybrid composite thread.

Flexible Interconnects

Figure 3:
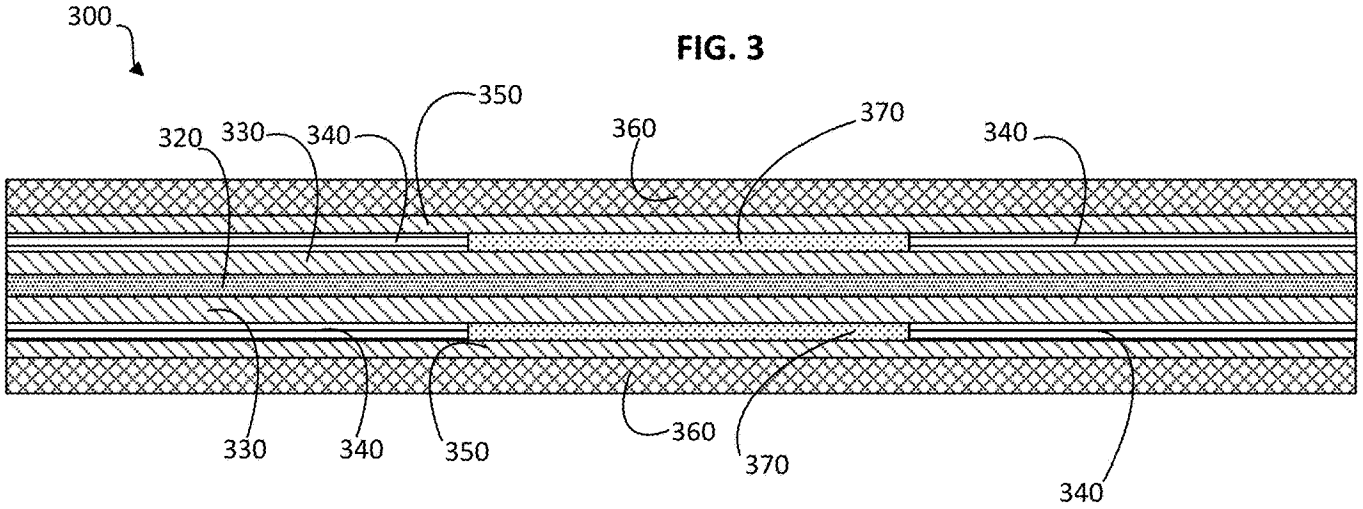
FIG. 3 provides a longitudinal cross sectional view of an embodiment of the invention that includes a fiber with an electrically active portion made using a continuous method.

FIG. 3 provides a longitudinal cross-sectional view of a functional fiber embodiment that incorporates specific electronic functionality. Functional fiber 300 can be produced using a continuous technique. Similar to the functional fiber shown in FIGS. 1A-B, functional fiber 300 includes a core 320, a first metallic or otherwise conductive layer 330, a dielectric layer 340, a second metallic or otherwise conductive layer 350 and an outer layer 360. The use of high capacitance material in the fiber can provide energy capacity, and this energy capacity can be increased, for example, by using twisted pairs of functional fibers. As shown in FIG. 3, dielectric layer 340 can be discontinuous and can be replaced by piezo functional layer 370 for one or more portions of the functional fiber so that the piezo functional material is electrically in series with an interconnect on both ends formed by the conductive layers 330 and 350. Piezo functional layer 370 may be, for example, a piezoelectric material or a piezo-luminescent material and can be embedded in the capacitance between conductive layers 330 and 350. In general, such piezo-based materials are transducers. In particular, a piezoelectric material translates pressure or touch into an electrical signal, and a piezo-luminescent material translates pressure or touch into a light signal. The resulting electrical/light signals can be used in various electrical and optical circuits, respectively, in accordance with some embodiments of the present invention. Functional fibers including transducers such as piezoelectric devices and piezo-luminescent devices can form part of a user interface. In some embodiments, the user interface may be woven into a fabric and may be in communication with a microprocessor or other electronic devices. Piezoelectric devices in the functional fibers can serve as input devices and may be responsive to human touch, for example, by outputting a corresponding signal. In a similar fashion, piezo-luminescent devices can provide output in the form of visible light in response to a user touch. In other embodiments, other types of input and/or output devices may be incorporated into a functional fiber that is woven into a fabric. Numerous user interface applications will be apparent in light of this disclosure.

The piezoelectric material may be organic or inorganic and can include, for example, quartz, polyvinylidene fluoride (PVDF), apatite, aluminum nitride, potassium sodium tartrate, lead zirconate titanate, zinc oxide composite, barium titanate, lithium tantalite, lanthanum gallium silicate, bismuth ferrite, lead scandium tantalate and gallium phosphate. Examples of piezo luminescent materials include alkali halides, ferro-electric polymers and quartz materials. In some embodiments, the piezoelectric or piezo-luminescent material may be flexible. In these embodiments, materials such as polymers (e.g., PVDF), lead zirconate titanate and zinc oxide composite may be preferred. Functional fibers including piezo functional materials as described herein may be woven into fabrics and formed into twisted pairs as shown in FIGS. 2A and 2B, in some embodiments.

Piezo functional materials can provide functional fibers with functionality that allows the functional fibers to respond to pressure. For example, a piezo functional fiber woven into a shirt can serve to activate a switch by pressing or bending the portion of the fabric that includes the piezo functional portion. By monitoring resistance between ends of the electrically functional fiber (e.g., by way of the conductive interconnect portions 330 and 350), one is able to detect when a piezoelectric material in series with the fiber has been activated. Resistance may increase or decrease as a result, depending on the type of piezo active material that is used. If more than one piezoelectric device in series in a fiber is activated, the change in resistance will be proportionally greater. In this manner, one can detect the difference between pressure over a small portion of the fiber (or fabric) and pressure over a larger portion of the fiber. For instance, the difference between a finger pushing on a fiber and a hand pushing on the same fiber could be detected by a greater change in resistance due to pressure contact on a greater number of piezoelectric devices. The active portion of the fabric may be identified by color or other indicia but in some embodiments is not visually identifiable or otherwise highlighted and can blend in with the rest of the fabric.

Functional fibers including piezo functional materials may be of consistent diameter throughout their length, in some embodiments. The portion of a functional fiber including a piezo functional material can have a same or similar diameter as the portion of the functional fiber comprising an interconnect. The length of a piezo active portion of a functional fiber may be selected to elicit a detectable response when activated. In some cases, the length of the piezo active portion may, for example, fall within a range having a lower limit of 10 nm, 100 nm, 1 μm, 10 μm, 100 μm or 1 mm and an upper limit of 1 μm, 1 mm, 1 cm or 10 cm. In embodiments where the piezo active portion is not flexible, the portion may be shorter than in other applications. For instance, the piezo active portion may be less than 1 mm, less than 100 μm. less than 10 μm, or less than 1 μm in length. Multiple piezo active materials may be formed in a functional fiber at consistent and/or varying intervals along the fiber. For example, a 1 mm length of piezo functional material may be formed in a functional fiber at 1 cm intervals along the fiber. Regular intervals can be used to assure that when pressure is applied anywhere along the functional fiber by, for example, a human thumb or finger(s) or hand, at least one piezo functional portion will be activated.

In some cases, a piezo functional material may not spontaneously return to its initial state after being activated, thereby effectively providing a memory cell. The value of the cell can be read out using the conductive interconnect 330 and 350, and can be based, for instance, on the resistive state of the piezo functional material (e.g., a high resistance value can be a logical 1, and a low resistance can be a logical 0, assuming a binary system). To re-set these materials, a charge or current can be applied to the functional fiber to re-set or re-activate the piezo components. In this manner, the functional fiber can be effectively programmed and unprogrammed repeatedly. A functional fiber including a piezo luminescent device can be used in a similar fashion, except that the output signal is light. In embodiments where the output signal is light, the light can be in the visible range, the infrared range or the UV range, for example.

In addition, a functional fiber including a piezo luminescent device could be used in clothing to inform the user that a desired user control input to electronics embedded within the fabric has been received or that a sufficient charge is available to power such embedded electronics or to store a user input in an optical-based memory cell of the embedded electronics has received data. Numerous other applications will be apparent in light of this disclosure. For example, a functional fiber including a piezo luminescent device could be used on and/or in an automobile and/or test dummy to indicate where impact points occur during a test crash. The luminescent device could then be re-set for one or more subsequent tests. Similar embodiments can be used to identify stress points during accidents for the purpose of, for example, providing immediate assistance and remedial action for victims. Other lighting devices can be used and may include luminescent, electroluminescent and electrophosphorescent devices, such as, for example, light emitting diodes (LEDs). Optical circuits such as memories and sensors may be implemented with such fabric-embedded circuits, for example.

Figure 4:
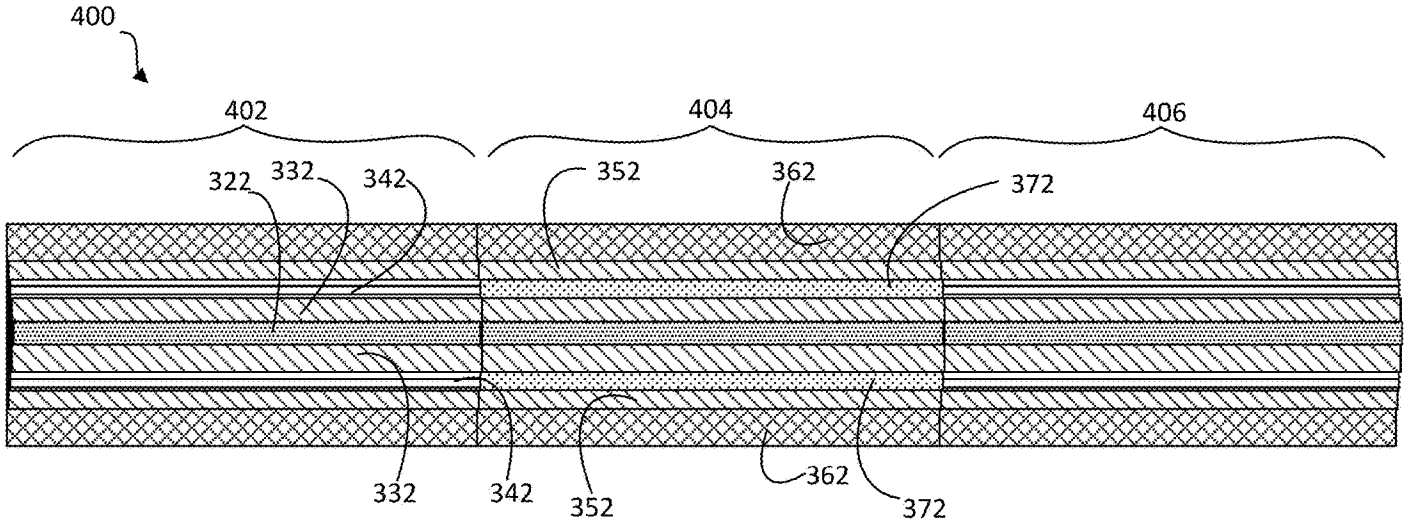
FIG. 4 provides a longitudinal cross sectional view of an embodiment of the invention that includes a fiber with an electrically active portion produced by joining portions together.

FIG. 4 provides a longitudinal cross-sectional view of a functional fiber that incorporates specific electronic functionality in accordance with another embodiment. Functional fiber 400 is similar to functional fiber 300, except that functional fiber 400 is non-continuous and is made by bonding individual segments 402, 404 and 406 together. Both 402 and 406 are interconnects while section 404 is a piezo active segment. Similar to the functional fiber shown in FIGS. 1A-B, functional fiber 400 includes a core 322, a first metallic or otherwise conductive layer 332, a dielectric layer 342, a second metallic or otherwise conductive layer 352 and an outer layer 362. As shown in FIG. 4, dielectric layer 342 can be discontinuous and can be replaced by piezo functional layer 372 for one or more portions of the functional fiber so that the piezo functional material is electrically in series with an interconnect on both ends formed by the conductive layers 332 and 352. Piezo functional layer 372 may be, for example, a piezoelectric material or a piezo-luminescent material and can be embedded in the capacitance between conductive layers 332 and 352. The previous relevant discussion with respect to piezo functional layer materials is equally applicable here.

Functional Grids

Figure 5:
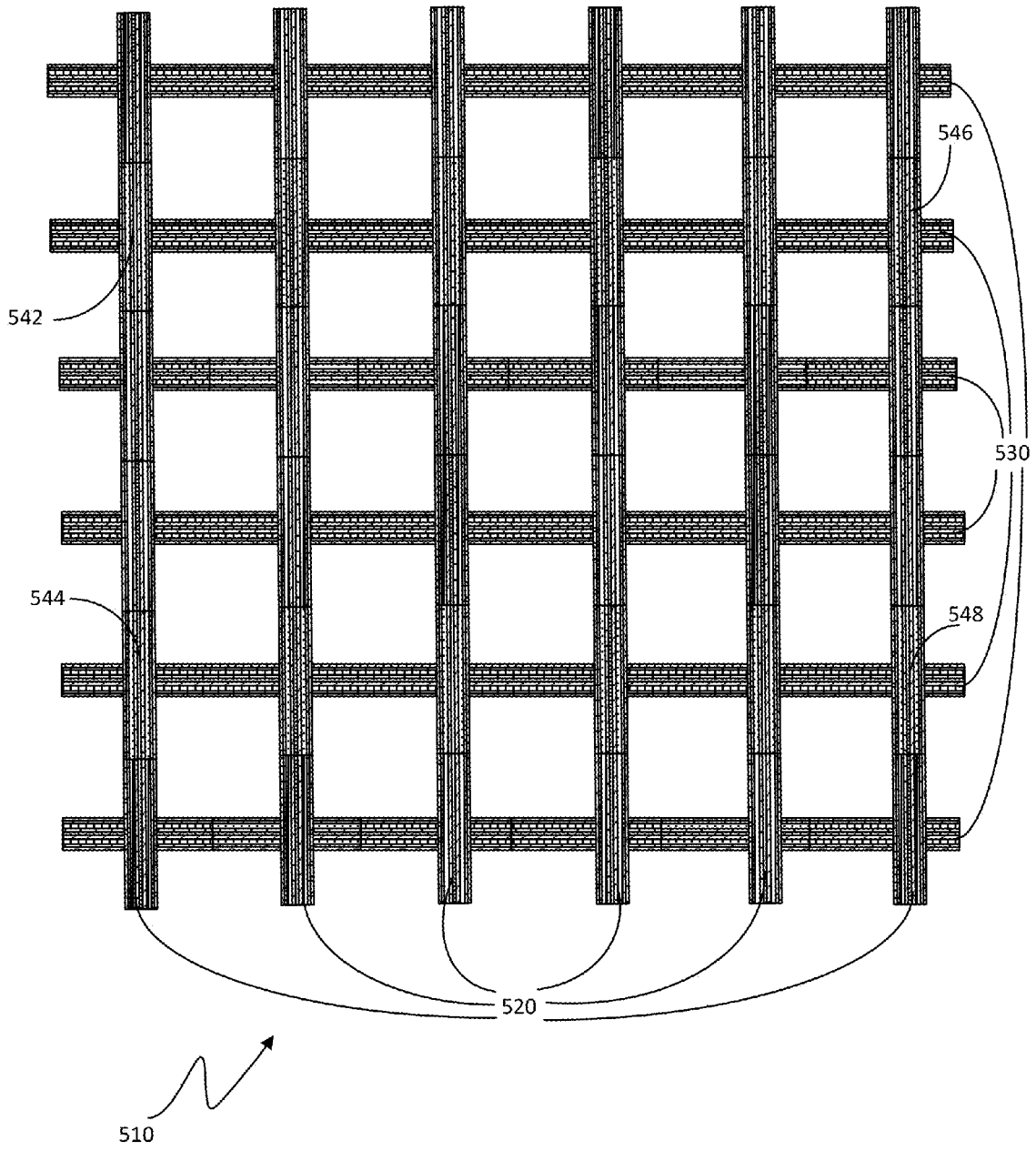
FIG. 5 illustrates a grid of functional fibers in accordance with one embodiment of the invention.

The electrically functional fibers described herein can be formed into two dimensional grids such as shown in the schematic diagram provided in FIG. 5. The embodiment shown depicts an electrically functional grid 510 that includes a series of vertically oriented functional fibers 520 and a series of horizontally arranged functional fibers 530. As shown, the vertical fibers are positioned in one plane on top of the horizontal fibers which are in a second plane, but in other embodiments the fibers may be interwoven together (see FIG. 7 for example). Fibers may also be arranged at other angles, such as, for instance, diagonally at 45 degrees to horizontal and may also be curved. In the embodiment shown, the horizontal functional fibers 530 are a series of interconnects and include no electrical devices. These horizontal fibers 530 can be used to carry current or a control signal and in the embodiment shown exhibit the example structure shown in FIGS. 1A-B. Vertical fibers 520 may include an electronic device such as piezoelectric device 542 or piezo luminescent device 544. Fibers 520 may include 0, 1, 2, 3 or more electronic devices per fiber and the function of each of the devices may be the same or different. The functional devices may be spaced evenly or may be spaced at differing intervals or strategically in a pattern to form, for instance, a pressure sensitive switch region or a pressure sensitive lighted region. In one specific application, the functional grid of fibers can be used as a touch interface to communicate with a computing device integrated within the fabric or otherwise carried by the user. In some such cases, the functional grid may receive user contact and, in response to that contact, provide an electro-magnetic (and/or opto-magnetic) signal directly to a computing device input, or to a remote computing device by way of electro-magnetic (and/or opto-magnetic) communication channels implemented within the functional grid.

Figure 6A:
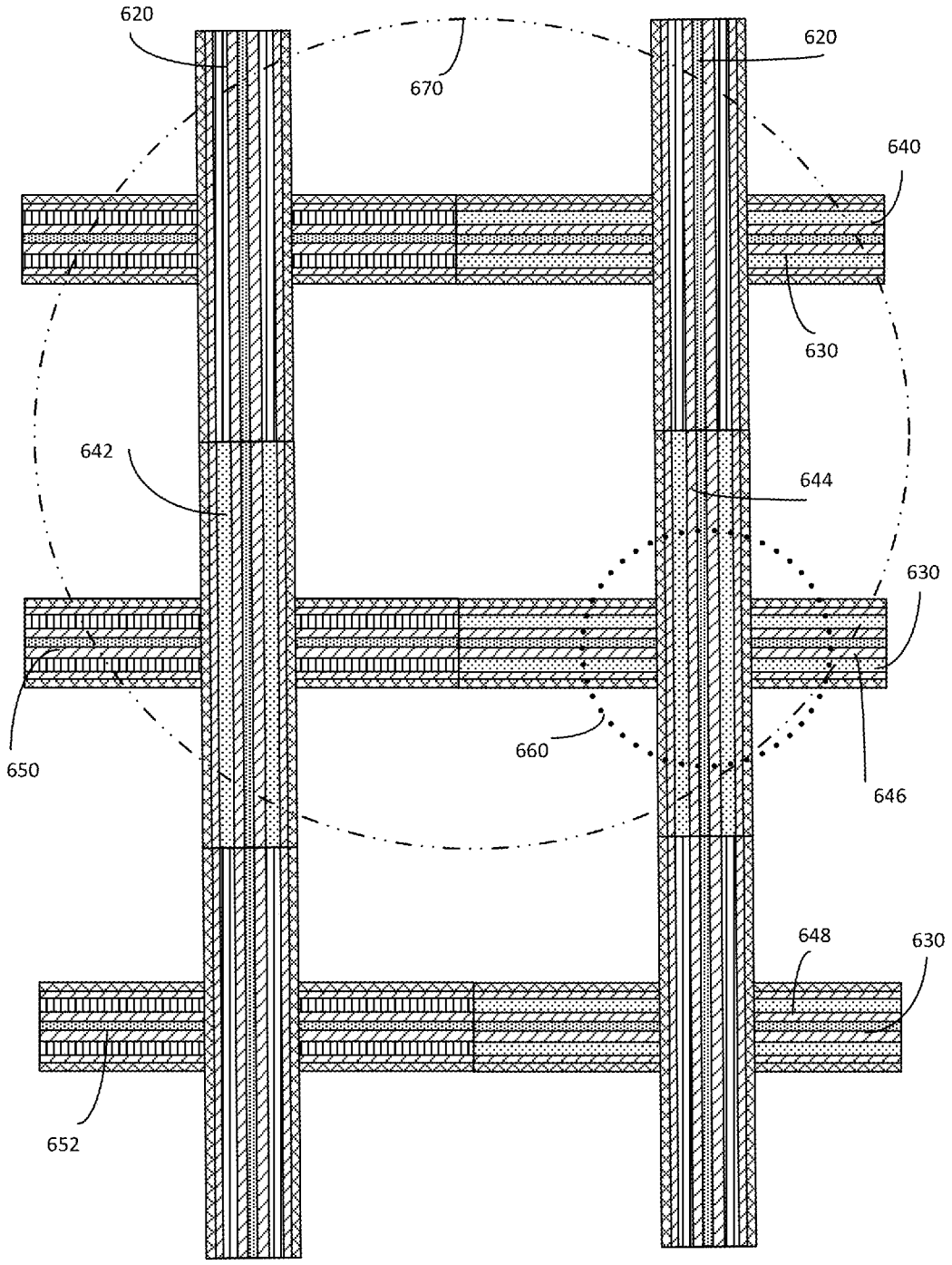
FIG. 6A provides a closer view of a portion of the embodiment shown in FIG. 5.

FIG. 6A provides a closer view of a grid such as that shown in FIG. 5. As can be seen, this example grid includes vertical functional fibers 620 and horizontal functional fibers 630. In the embodiment shown, both the horizontal and vertical functional fibers include electrical devices 640, 642, 644, 646 and 648. These devices may be, for example, transducers such as piezoelectric devices and piezo luminescent devices, or capacitors. They may be connected to other devices, circuits, switches or connectors via interconnects such as 650 and 652. As shown in FIG. 6A, one device 644 may directly overlap a second device 646. In such an embodiment, the devices may be the same or different. For instance, both device 646 and device 644 can be piezo functional devices. The devices may be used to activate two different functions or may be used as a backup to each other and/or otherwise may activate the same function. For example, pressing on a fabric incorporating a functional grid with a finger or thumb may provide inadequate specific pressure to deform the device, particularly when the fabric is against a soft, resilient material such as human skin. By doubling up on the devices, a small point of contact between the crossed devices is provided and a force applied broadly to circled area 660 will be concentrated at the point of contact of the two devices, providing an increased probability of deforming either device 644, 646, or both. In a similar manner, larger areas of sensitivity can be made, for instance, by duplicating the arrangement of devices 644 and 646 at four corners of a square using a total of eight piezoelectric devices. One such square (not showing piezoelectric devices in the figure) is indicated by dashed circle 670. If pressure is then applied anywhere in the broad circled area indicated by 670, at least one of the devices is likely to be deformed to an extent where it can be detected and optionally used to activate a predetermined function. As will be appreciated in light of this disclosure, the grid may also include textile fibers interspaced between the functional fibers.

Figure 6B:
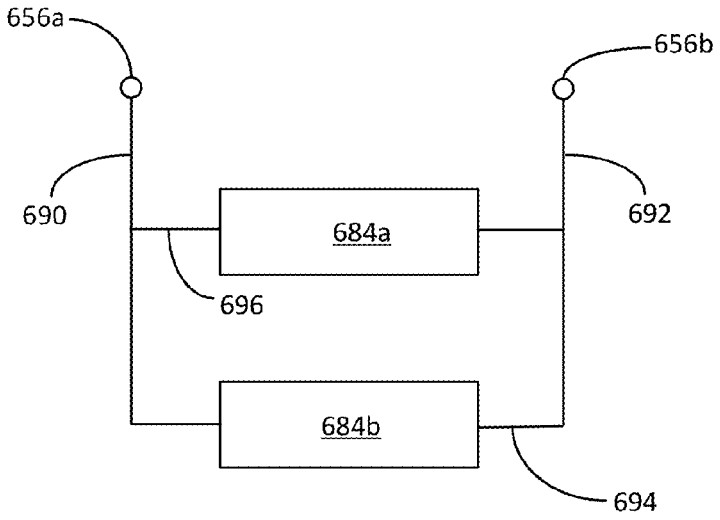
FIG. 6B provides an electrical schematic diagram of functional fibers in one embodiment of the invention.
Figure 8:
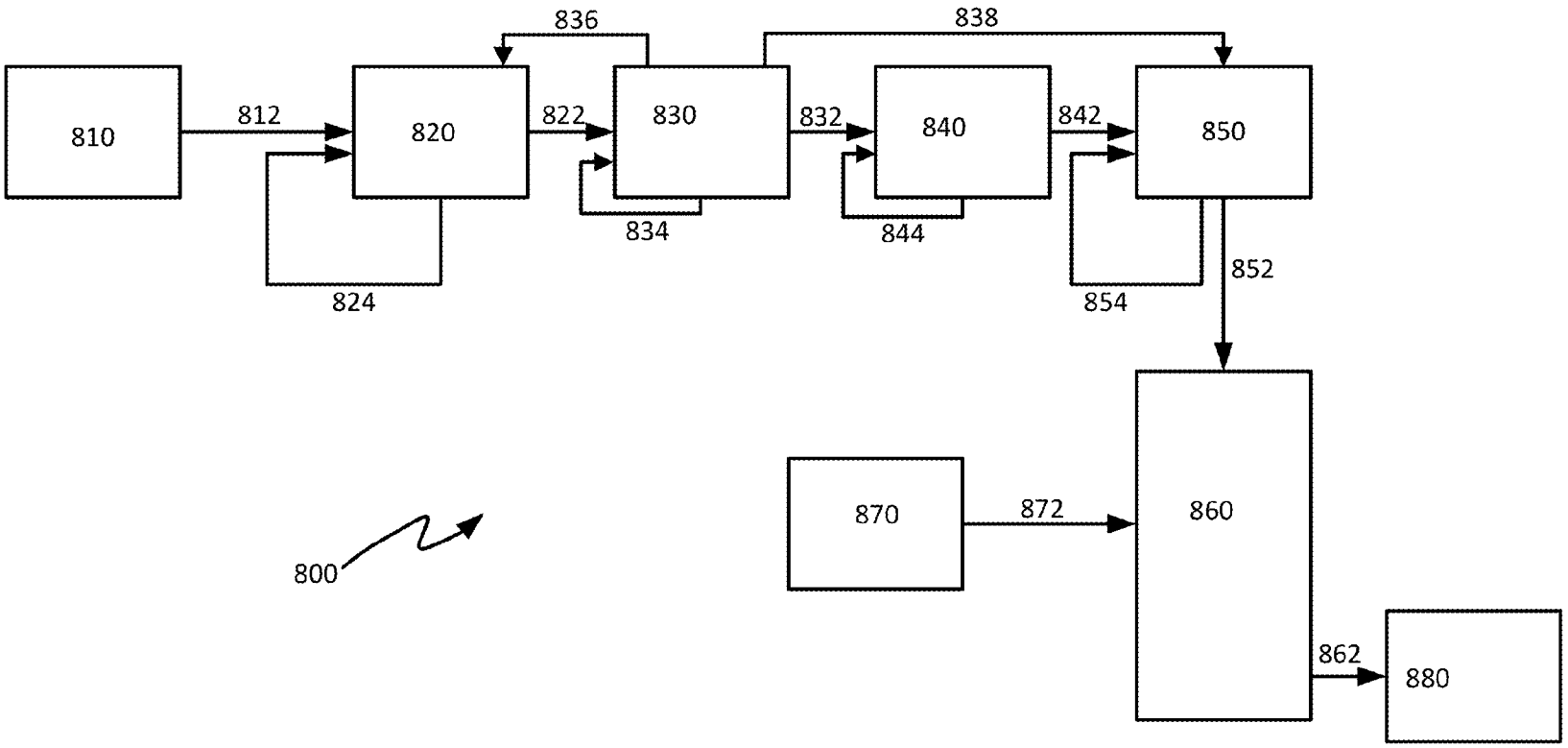
FIG. 8 provides a flow chart explaining one embodiment of a flexible electrically functional fiber production method.

FIG. 6B provides a schematic diagram of one specific embodiment that can be implemented using a grid such as that shown in FIG. 6A. For instance, in one embodiment, devices 684*a* and 684*b* can correspond to devices 644 and 646 in cross sectional diagram FIG. 6A. Similarly, interconnects 620 and 630 in FIG. 6A are represented, in this specific embodiment, by interconnects 690, 692, 694 and 696. As devices 684*a* and 684*b* are in a parallel electrical circuit, activation of either or both devices can be detected across contact points 656*a* and 656*b*. For example, if 684*a* and 684*b* are piezoelectric devices, physical activation of either device, both devices, can be detected by a change in resistance across contact points 656*a* and 656*b*. Thus, if devices 684*a* and 684*b* represent piezo active devices 644 and 646 from the embodiment of FIG. 6A, application of pressure to area 660 (FIG. 6A) will cause a detectable change across contact points 656*a* and 656*b* whether device 644 is deformed, device 646 is deformed or both devices 644 and 646 are deformed. In another embodiment, an electrical signal can be applied to either one of or otherwise across contact points 656*a* and 656*b* to activate electrical devices 684*a* and 684*b*. As used here, activating a device 684*a-b* may include, for example, storing a potential in the device, biasing a junction of the device, causing a transducing effect in the device (e.g., converting signal to light, converting signal to pressure, converting signal to vibration, converting signal to movement, etc). To this end, devices 684*a* and 684*b* can be, for example, a capacitor, a variable resistor, a piezo-electric device, a piezo-luminescent device, an LED, a transistor or other active device having one or more active junctions, a transducer or sensor (e.g., electro-optical transducer, piezo-based transducer, MEMS-based sensor), or any other electronic device that can be formed in the context of a functional fiber using a stepped fabrication process such as the example one described with reference to FIG. 8.

Figure 6C:
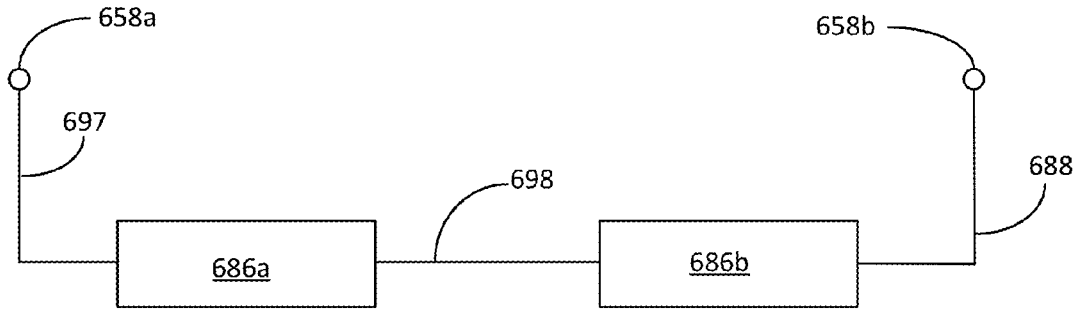
FIG. 6C provides an electrical schematic diagram of functional fibers in another embodiment of the invention.

FIG. 6C provides a schematic diagram of another specific embodiment that can be implemented using a grid such as that shown in FIG. 6A. For instance, in one embodiment, devices 686*a* and 686*b* can correspond to devices 644 and 646 in cross sectional diagram FIG. 6A. Similarly, interconnects 620 and 630 in FIG. 6A are represented, in this specific embodiment, by interconnects 697, 698 and 688. As devices 686*a* and 686*b* are electrically in series, activation of either or both devices can be detected across contact points 658*a* and 658*b* in this embodiment. Thus, if either piezo active device 686*a* or 686*b* is deformed, the physical change can be detected electrically. For instance, a similar change in resistance could be detected across contact points 658*a* and 658*b* when either device 686*a* or device 686*b* is deformed. In another embodiment, if both devices 686*a* and 686*b* are activated by deformation contemporaneously, for example, an increased change in resistance across contact points 658*a* and 658*b* can be detected, indicating that not one, but both (or three, four or more in similar embodiments) piezo active devices have been activated. Thus, if devices 686*a* and 686*b* represent piezo active devices 644 and 646 from the embodiment of FIG. 6A, application of pressure to area 660 (FIG. 6A) will cause a detectable change across contact points 658*a* and 658*b* whether device 644 is deformed, device 646 is deformed or both devices 644 and 646 are deformed. In a case where both devices 644 and 646 are deformed, the detected change in electrical activity (e.g., resistance) can be greater, for example, twice as great, as if only one of the devices is deformed. This scheme may be incorporated, for instance, in embodiments where it is useful to know the size (e.g., length, height, width, area) of an area of fabric that has been pressure activated. In another embodiment, an electrical signal can be applied to contact points 658*a* and 658*b* to activate electrical devices 686*a* and 686*b*. The previous discussion with respect to activating a device and device types is equally applicable here.

Figure 7:
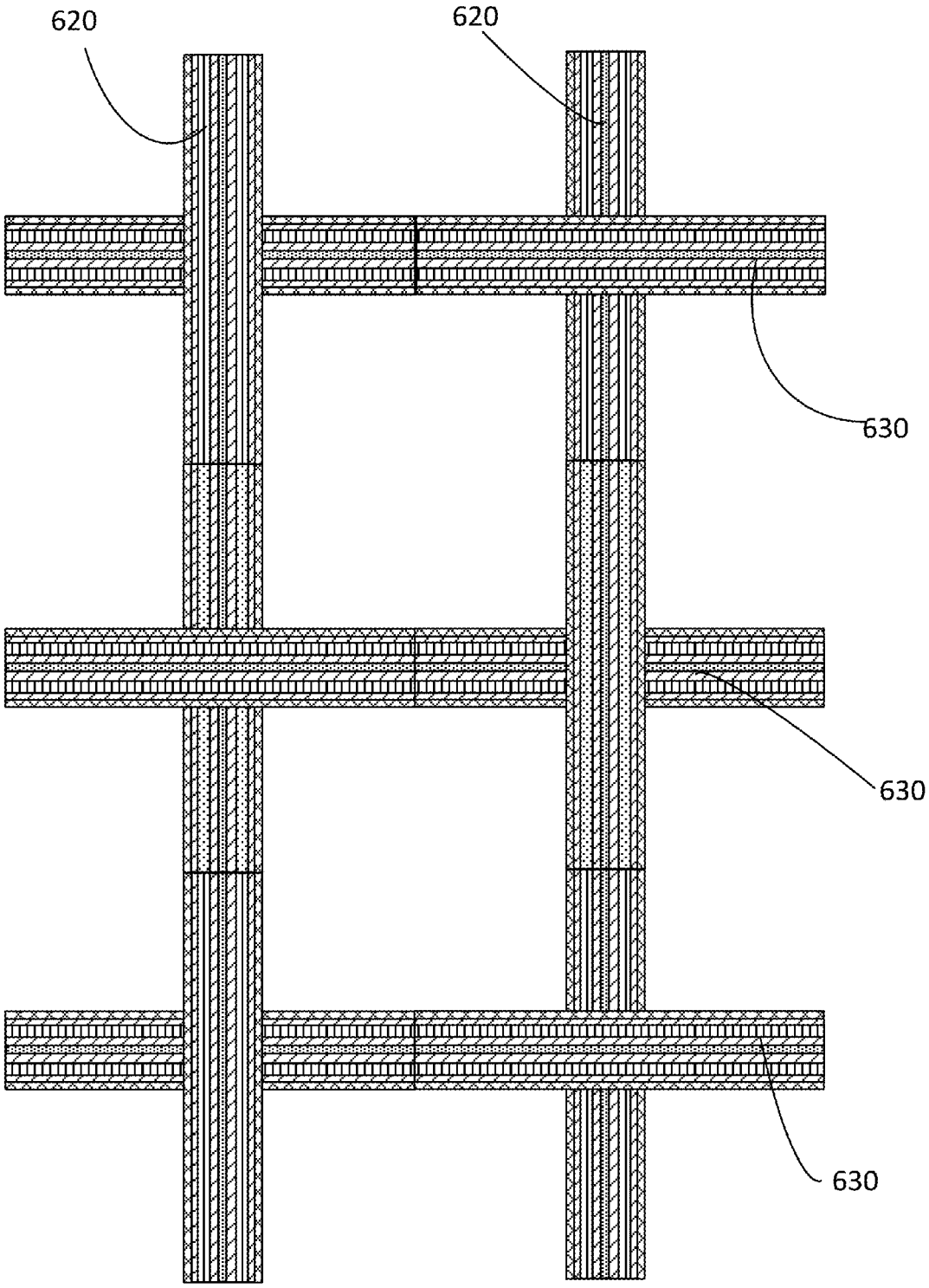
FIG. 7 illustrates a woven version of the grid of FIG. 5 in accordance with another embodiment of the invention.

FIG. 7 shows an embodiment similar to that illustrated in FIG. 6A except that the vertical fibers 620 and horizontal functional fibers 630 are woven together. In this manner, the horizontal and vertical fibers are not in different planes but rather alternate with regard to positioning on the top and bottom layer. Numerous weave patterns can be used, and the claimed invention is not intended to be limited to any particular one. Any number of non-functional fibers, such as textile fibers, may be woven in with the functional fibers to form a fabric. Thus, the fabric, by mass or by surface area, may be 100% functional fiber, 50 to 100% functional fiber, 20 to 50% functional fiber, 10 to 20% functional fiber, 5 to 20% functional fiber, 1 to 10% functional fiber, 1 to 5% functional fiber, 0.1 to 5% functional fiber, 0.1 to 1% functional fiber or from greater than 0 to 0.1% functional fiber. Similarly, the fabric may contain, greater than 50%, greater than 75%, greater than 90%, greater than 95%, greater than 99% or greater than 99.9% textile fiber, by weight or by surface area. Embodiments using woven functional fabrics may include the same devices, such as piezoelectric and piezo luminescent devices, as do the embodiments using layered functional grids, such as that described above and in FIG. 6A.

An electrically functional grid, such as that shown in FIGS. 6A and 7 can be attached to or interwoven with a fabric that can comprise textile fibers. Functional grids can be temporarily or permanently attached to the surface of a fabric. Methods of attachment include, for example, adhesives such as pressure sensitive adhesives, hot melt adhesives and radiation cured adhesives; heat bonding, lamination between additional layers of laminating materials, and stitching. In one embodiment, the ends of functional fibers (620, 650 for example) can form tabs that can be bent to about 90 degrees, poked through a fabric, and then bent back on themselves to about 180 degrees to secure the grid to the fabric. Removal of the grid can be achieved by unbending the tabs and reversing the procedure.

In embodiments where a functional grid is fully woven with a textile fabric, the components can be integrated in a variety of ways. For example, a textile fabric can be woven into a pre-existing functional grid, the functional grid can be woven into a pre-existing textile fabric, or functional fibers can be interwoven with textile fibers to produce a hybrid woven fabric in which functional fibers and textile fibers are woven together. As many of the functional fibers described herein exhibit properties similar to textile fibers (e.g., can be wound onto a spool), the two types of fibers can be woven together using weaving techniques that are known in the textile arts, such as, for example, weaving on a loom.

In addition to 2-dimensional woven and non-woven grids, functional fibers may be formed into three dimensional structures. For example, six squares of the grid as shown in FIG. 5 may be connected together in a stacked formation so as to form a cube. Similarly, fibers may be woven or otherwise formed into spheres or irregularly shaped objects. These three dimensional structures may include non-functional fibers as well.

Manufacturing Methodologies

The electrically functional fibers described herein can be produced using a variety of methods, including both continuous processes and batch type processes. One embodiment of a continuous process is shown schematically in FIG. 8. In process 800 a starting fiber is provided from fiber source 810. The fiber will become the core of the functional fiber and can be a natural or synthetic fiber such as cotton, silk or polyester. Starting fiber 810 need not be conductive, and may also be sacrificial in some embodiments (where it is burned out or otherwise removed after formation of the functional fiber). As fiber 810 is fed via 812 and pulled through initial coating device 820 it can be coated with a first conductive layer, such as a metal or conductive polymer. Suitable coating methods include, for example, chemical vapor deposition (CVD) and atomic layer deposition (ALD). The deposition process can be controlled, for example, by regulating the supply of material being deposited or by adjusting the velocity at which the fiber is advanced through coating device 820. The fiber can be evenly coated for its entire length or the coating thickness can be varied, or even eliminated, for portions of the fiber. If additional layer thickness is needed the fiber can be passed through coating device 820 one or more additional times via 824. When the first metallic coating is of adequate thickness the fiber can be passed from coating device 820 to second coating device 830 via 822. Second coating device 830 applies a layer of insulating material (e.g., low-k, high-k, silicon dioxide, etc) using, for example, CVD or ALD. The coating may be applied evenly along the fiber or portions void of insulator/dielectric material can be left at predetermined intervals, or as otherwise desired. In a later step, the void portions may be coated with an electrically active material, such as a piezoelectric material. Alternatively, the piezoelectric material (or other electrically active material) can be applied in second coating device 830 at the same time as the insulative layer is being applied. For example, second coating device 830 can be programmed to apply alternating portions of insulative material and piezoelectric material in the same layer on the fiber during a single pass. The fiber may take multiple passes through coating device 830 via 834 or can be passed back to first coating device 820 via 836. As will be appreciated in light of this disclosure, the process of FIG. 8 can also be configured to modify the material deposition on the fly to create, for example, alternate layers of high capacitance and low capacitance areas on the fiber, depending on the thickness and/or type of dielectric material used between the conductive layers.

In a further embodiment, second coating device 830 can apply a pre-polymer of, for example, a low-k polymer (or other polymer having a suitable dielectric constant for a given application) by methods such as dipping or spraying. Additives may be included in the pre-polymer to take advantage of the specific surface energy of the first conductive layer so that a desired thickness of pre-polymer is retained on the fiber via surface tension. Portions of the fiber may then be selectively cured by, for example, UV radiation. Uncured portions of pre-polymer may be rinsed, vaporized or otherwise removed from the fiber to produce portions that are void of low-k polymer. These void portions can then be coated, in third coating device 840 via 832, for example, with an electrically functional material such as a ferroelectric polymer. Fiber may be passed through coating device 840 multiple times via 844.

After the third layer of the fiber is complete, it can include, for example, low-k material, electrically functional materials such as piezoelectric materials, or linear portions of each. The fiber may then be pulled through third coating device 840 which can apply a second electrically conductive layer. The methods of application can be the same or different from those used to apply the first conductive layer in coating device 820. As with coating device 820, the fiber may be passed through third coating device 840 one, two, three or more times via 844.

After the second conductive coating has been applied, the fiber can be passed to coating device 850 from coating device 840 via 842 or directly from coating device 830 via 838. Final coating device 850 can apply an insulative coating such as a polymer. The polymer, for example PVC, may be applied using any suitable conventional method. The polymer may be mixed with textile fibers to provide the coating with the look and feel of a textile fiber. The polymer may include a pigment to provide color or may be translucent or transparent. After the insulative coating has been applied, the coating may be treated in a secondary operation, such as ozone treatment, to render the coating more amenable to dyes that may be applied to the fiber after it has been woven into a fabric.

After the coating has been applied, or at any other point during process 800 the functional fiber can be stored on a spool. After completion, the functional fiber can be passed to weaving device 860 via 852 where it can be incorporated into a fabric along with textile fibers provided by fiber source 870 via 872. The functional fiber can be woven conventionally with textile fibers into an electrically functional fabric or can be made into an electrically functional non-woven fabric. The functional fibers in the fabric may form a circuit and the fabric may also incorporate a microprocessor. Thus, the fabric can include microprocessors, power sources, switches, input devices such as piezoelectric devices and output devices such as piezo luminescent devices. The fabric may be conveyed to coloring apparatus 880 via pathway 862 for dying and/or printing after it has been formed into a fabric in process 860. Alternatively, fibers may be dyed prior to being incorporated into the fabric. In many cases, the electrically functional fabric can be conventionally laundered without damaging the functionality of the fabric.

Figure 9:
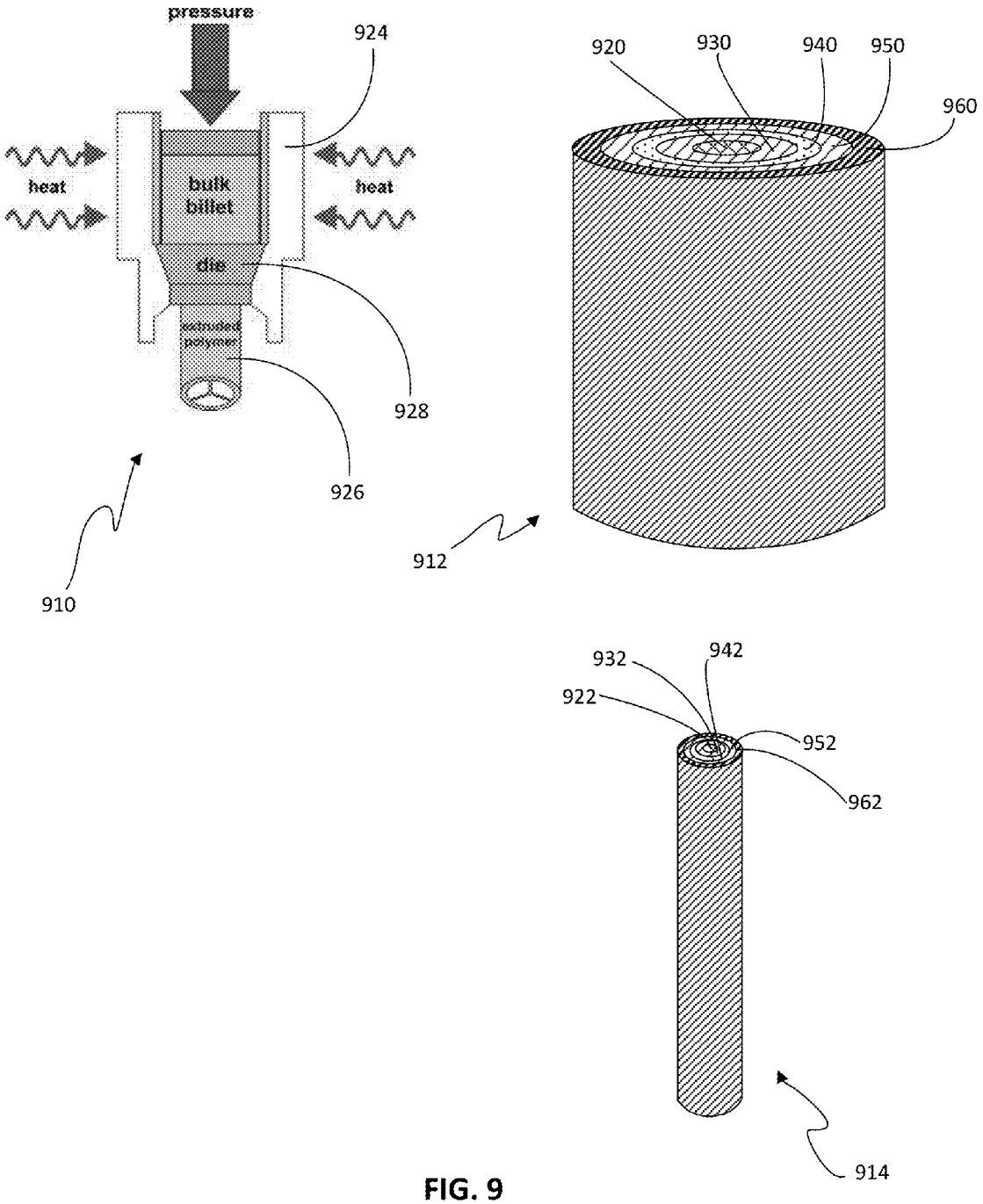
FIG. 9 illustrates another method of fiber production in accordance with an embodiment of the invention.

In another set of embodiments, multi-layered electrically functional fibers can be produced using an extrusion process. FIG. 9 illustrates a process whereby a billet 912 is extruded through extruder 910 to produce a flexible electrically functional fiber 914. Billet 912 can include any number of layers. As shown in FIG. 9, billet 912 includes core 920, conductive layer 930, dielectric layer 940, second conductive layer 950 and outer coating layer 960. Billet 912 is placed in extruder 910 where any combination of heat, head pressure and draw pressure can be applied to the billet. As the billet is extruded through die 928, billet 912 becomes a longer and thinner composite 926 while maintaining the same proportional composition of materials that make up billet 912. The corresponding elongated portions of the fiber become core 922, conductive layer 932, dielectric layer 942, conductive layer 952 and outer layer 962. The die may reduce the diameter of the billet by a factor of more than 2, 3, 5, 10, or more. Composite 926 may be drawn through a series of progressively smaller dies until a flexible electrically functional fiber 914 of desired thickness is achieved. For instance, a 1 inch diameter billet may successively be drawn down to a fiber that is less than 10 μm, less than 5 μm, less than 1 μm or less than 100 nm in diameter.

The layers that comprise a particular billet can be of compatible materials that will not flake or separate when forced through the die. For instance, the components of the billet should exhibit similar malleability at the temperature at which the extrusion takes place. In this manner, each layer will deform in a similar manner during the extrusion process, resulting in a fiber in which adjacent layers remain in contact with each other and the thickness of each layer is in proportion to its thickness in the original billet. In one embodiment, all of the layers comprise polymeric materials and the polymeric materials may exhibit glass transition temperatures that are similar. For instance, each of the materials in the billet may have a glass transition temperature that is within 100° C., within 50° C., or within 20° C. of the glass transition temperature of the other materials comprising the billet. The temperature of the extruder 910 may be optimized for a specific billet and in some instances may be greater than 100° C., greater than 200° C., greater than 300° C. or greater than 400° C. The extruder may also be operated at, or about, the glass transition point of one or more of the components of the billet.

In some embodiments, one or more of the layers can be extruded through die 928 and additional layers may be added using methods such as those described above in reference to the process shown in FIG. 8. For example, a billet may comprise core 920, conductive layer 930, low-k layer 940 and second conductive layer 950. After the billet has been reduced to an appropriately sized fiber a polymer coating layer 960 can be applied using conventional coating techniques. This allows for the inclusion of a softer coating where die extrusion of such a material would not be practical.

Figure 10:
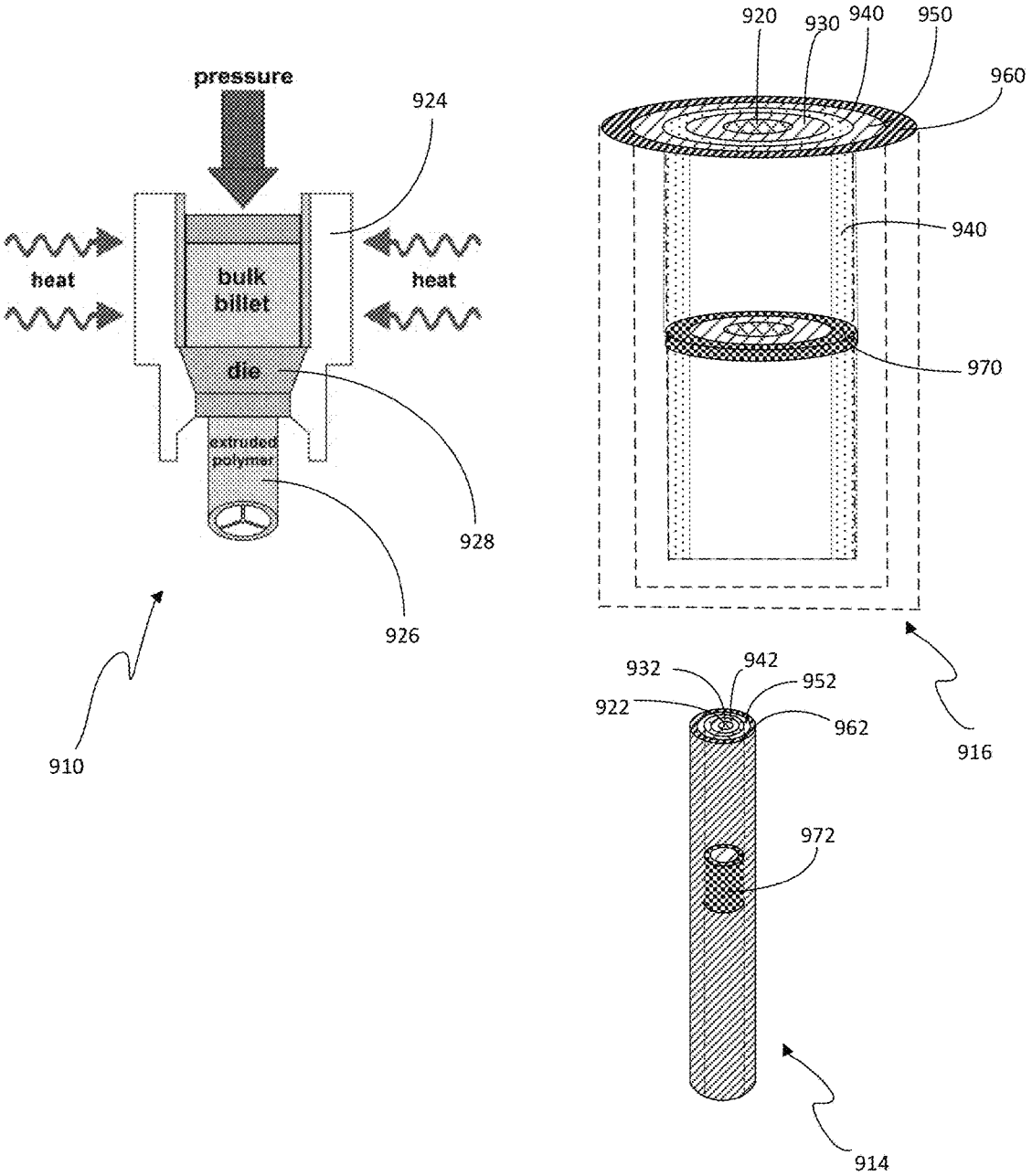
FIG. 10 provides another embodiment of fiber production.

FIG. 10 depicts a method of production similar to that shown in FIG. 9 except that one of the layers of the billet, in this specific embodiment the dielectric layer 940, is interrupted by different material. Billet 916 includes core 920, first conductive layer 930, dielectric layer 940, second conductive layer 950 and outer layer 960. In the embodiment shown, the additional material is piezoelectric material 970. When formed in billet 916 the piezoelectric material 970 may be a thin ring shaped disk having an outer diameter and inner diameter substantially equal to that of the insulator layer 940. The piezoelectric material may be, for example, lead zirconcate titanate. The resulting electrically functional fiber 914 will include each of the original components in the same ratios but extensively narrowed and elongated. For example core 920 becomes core 922; conductive layer 930 becomes conductive layer 932; dielectric layer 940 becomes dielectric layer 942; second conductive layer 950 becomes second conductive layer 952; and outer layer 960 becomes second outer layer 962. Lead zirconate titanate insert 970 becomes lead zirconate titanate insert 972 in the same proportion as included in the original billet. Therefore, if the lead zirconate titanate disk 970 is 1% of the height of the billet, then piezoelectric component 972 in functional fiber 914 will form 1% of the total length of the fiber. Additional layers may be inserted into the billet at desired positions and may be the same or different as first layer 970. These additional layers, as with lead zirconate titanate disk 970 should be compatible with the other billet materials so that extrusion does not lead to separation or flaking of the material.

The functional fibers described herein may be connected to each other and to other devices and systems to achieve electrical communication there between. In some embodiments, functional fibers may be connected in series using an aligned fusion process resulting in connected fibers as shown in FIG. 4. In other embodiments, an end portion of the non-electrical components (e.g., the core and the outer coating) can be removed and the remaining electrical components e.g., the high conductivity layers and low-k layer(s) or other suitable conductive/dielectric configuration) can be bonded together using, for example, heat, pressure, ultrasound or radiation. Functional fibers can be connected, for example, to other devices such as microprocessors, batteries, antennas, input devices and output devices using a similar technique.

Example System

As will be appreciated by those of skill in the art, the flexible fibers described herein can be integrated with a variety of computing systems. These computing systems may, in some cases, be physically and/or electronically connected to electronically functional flexible fibers. These computing systems can include a motherboard and the motherboard may include a number of components, including but not limited to a processor and at least one communication chip, each of which can be physically and electrically coupled to the motherboard, or otherwise integrated therein. As will be appreciated, the motherboard may be, for example, any printed circuit board, whether a main board or a daughterboard mounted on a main board or the only board of system, etc. Depending on its applications, the computing system may include one or more other components that may or may not be physically and electrically coupled to the motherboard. These other components may include, but are not limited to, volatile memory (e.g., DRAM), non-volatile memory (e.g., ROM), a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth). Any of the components included in the computing system may include one or more integrated circuits implemented with a low-k dielectric as described herein. In some embodiments, multiple functions can be integrated into one or more chips if so desired (e.g., for instance, note that the communication chips can be part of or otherwise integrated into the processor).

The communication chip enables wireless communications for the transfer of data to and from the computing system. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing system may include a plurality of communication chips. For instance, a first communication chip may be dedicated to shorter range wireless communications such as Wi-Fi and Bluetooth and a second communication chip may be dedicated to longer range wireless communications such as GPS, EDGE, GPRS, CDMA, WiMAX, LTE, Ev-DO, and others.

The processor of the computing system includes an integrated circuit die packaged within the processor. In some embodiments of the present invention, the integrated circuit die of the processor includes one or more transistors or other integrated circuit devices implemented with a fiber based integrated circuit as provided herein. The term "processor" may refer to any device or portion of a device that processes, for instance, electronic data from registers and/or memory to transform that electronic data into other electronic data that may be stored in registers and/or memory.

The communication chip may also include an integrated circuit die packaged within the communication chip. In accordance with some such example embodiments, the integrated circuit die of the communication chip includes one or more transistors or other integrated circuit devices implemented with a low-k dielectric as described herein. As will be appreciated in light of this disclosure, note that multi-standard wireless capability may be integrated directly into the processor (e.g., where functionality of any chips is integrated into processor, rather than having separate communication chips). Further note that processor may be a chip set having such wireless capability. In short, any number of processor and/or communication chips can be used. Likewise, any one chip or chip set can have multiple functions integrated therein.

In various implementations, the computing system may be a laptop, a netbook, a notebook, a smartphone, a tablet, a personal digital assistant (PDA), an ultra-mobile PC, a mobile phone, a desktop computer, a server, a printer, a scanner, a monitor, a set-top box, an entertainment control unit, a digital camera, a portable music player, or a digital video recorder. In further implementations, the system may be any other electronic device that processes data or employs transistor devices or other semiconductor devices that can be implemented with a fiber based system. As will be appreciated in light of this disclosure, various embodiments of the present invention can be used to improve performance on products fabricated at any process node (e.g., in the micron range, or sub-micron and beyond) by incorporating into these products a flexible electrically functional fiber.

In accordance with some of the embodiments disclosed herein, aspects of the invention may include, for instance, one or more of the following elements, in any combination. Any features or ranges provided are not to restrict the scope of various embodiments. A flexible electrically functional fiber can comprise a core, a first conductive layer adjacent the core, a dielectric layer adjacent the first conductive layer, a second conductive layer adjacent the dielectric layer, and an insulative coating surrounding the second conductive layer, wherein the flexible electrically functional fiber has a natural bending radius of less than 2.0 mm. The functional fiber may have an average diameter of less than 10 μm, less than 5 μm or less than 1 μm.

Functional fibers may have a natural bending radius of less than 1.0 mm, less than 0.75 mm or less than 0.5 mm. The core of the fiber may comprise one or more textile fibers, natural fibers, a liquid, a void or a polymer. The functional fiber can include one or more conductive layers where the conductive layers comprise, for example, a metal, a polymer or a non-metal. The one or more conductive layers may have a resistance of less than $10^{-4}$ Ω·m or less than $10^{-7}$ Ω·m. The dielectric layer(s) may have a dielectric constant of less than 3.9 or less than 3.0 and can be translucent and may be interrupted along the length of the fiber.

Functional fibers may include an input device, a power source, memory cell, a communication channel, an interconnect, a capacitor, and/or an output device. An input device may comprise a piezoelectric material and the piezoelectric material can be selected from at least one of quartz, polyvinylidene fluoride, apatite, aluminum nitride, potassium sodium tartrate, lead zirconate titanate, zinc oxide composite, barium titanate, lithium tantalite, lanthanum gallium silicate, bismuth ferrite, lead scandium tantalate and gallium phosphate. A functional fiber may also include a power source wherein the power source comprises a capacitor. A functional fiber may also include an output device wherein the output device comprises a piezo luminescent material, and the piezo luminescent material can comprise at least one of an alkali halide, a ferro-metallic material or quartz. Layers making up a functional fiber may have a thickness of less than 1 μm or less than 100 nm. Functional fibers can be in the form of twisted pairs of conductors, and the twisted pairs can include a textile fiber, a functional fiber or both. In twisted pairs that include both functional fibers and textile fibers the textile fiber can run substantially parallel to the functional fiber, substantially perpendicular to the functional fiber and the textile fibers may be retained between the fibers that comprise a twisted pair. Multiple twisted pairs may be used together.

Woven or non-woven fabrics may include one or more of the functional fibers described above and elsewhere herein. For example, a woven or non-woven fabric can include textile fibers. A fabric may also include a second functional fiber positioned substantially perpendicular to a first functional fiber. The fabric may have first and second functional fibers that overlap. The fabrics may include a touch sensitive piezoelectric device, an output device comprising a piezo luminescent device, a power source or a capacitor. A fabric may include functional fiber(s) that are the same color as the fabric and the functional fiber may be dyed separately or together with the fabric.

Methods of producing flexible electrically functional fibers can include any one or more of the following steps: coating a fiber core with an electrically conductive material to form a first electrically conductive layer; applying a dielectric material to the first electrically conductive layer to form a dielectric layer; applying an electrically conductive material to the dielectric layer to form a second electrically conductive layer; and/or applying an outer coating material to the second electrically conductive layer to produce the flexible electrically functional fiber. The materials can be applied using a continuous process and can be applied using chemical vapor deposition or atomic layer deposition. The layers may be applied in thicknesses that do not exceed 500 nm in thickness. Any electrically conductive materials may comprise a metal or a polymer. The inner layer or core may be a textile fiber. An application of electrically conductive material can be repeated prior to applying the dielectric material. The process may be altered during the coating or applying process to provide a flexible electrically functional fiber having portions of high capacitance and portions of low capacitance. A dielectric layer can be applied intermittently to provide portions of dielectric layer separated by portions void of dielectric material. An electrically active material different from the dielectric material can be applied on portions of the first conductive layer and this can be done during a single pass of the core fiber. Applying the dielectric layer can include applying a pre-polymer to the first electrically conductive layer and polymerizing at least a portion of the pre-polymer. Any non-polymerized portions of pre-polymer can be removed from the first electrically conductive layer to produce portions void of dielectric material and an electrically active material can be applied to the portions that are void of dielectric material. Methods may include, for example, application of electrically active material(s) that comprise a piezo active material that may be a piezo active material that comprises a piezoelectric material. The piezo active material may include a piezo luminescent material. A method can also include winding the flexible electrically functional fiber on a spool after at least one of the coating or applying steps. Any outer coating may be treated to render it more amenable to dyes. The method may also include dying a flexible electrically functional fiber, and a flexible electrically functional fiber may be woven into a fabric. The fabric may be manufactured into, for example, electrically functional clothing, outerwear, footwear, uniforms or upholstery. In some embodiments, the fabric can be laundered without losing electrical functionality of the fabric, and the fabric may be subjected to agitation in water and drying at greater than 100° C.

Another aspect includes a method of producing a flexible electrically functional fiber, the method comprising one or more of: forming a billet comprising concentric layers including a core, a first conductive layer, a dielectric layer and a second conductive layer, and forcing the billet through a die to produce the flexible electrically functional fiber having a reduce diameter and increased the length compared to the billet. A billet may be forced through multiple dies of decreasing size and the flexible electrically functional fiber can have a diameter that is less than $1/100^{th}$ the diameter of the starting billet. The resulting flexible electrically functional fiber can have a natural bending radius of less than 2.0 mm and a protective coating can be applied to the second conductive layer after the billet is forced through the die. In some embodiments, the dielectric layer in the billet can be interrupted by a ring of different material that is electrically active and has an inner diameter and outer diameter substantially equivalent to the inner and outer diameter of the dielectric layer in the billet. The ratio of the diameter of the different electrically active material to the length of the billet is substantially equivalent to the ratio of the final length of the different electrically active material to the length of the flexible electrically functional fiber. The different electrically active material can comprise a piezo active material. A method may include applying heat to the die, and in some cases the billet can be heated to approximately the glass transition temperature of at least one of the core, the first conductive layer, the dielectric layer or the second conductive layer.

In another aspect, a user interface can include any of the fabrics described above. For example, the user interface may include a fabric that has a piezoelectric input device and the piezoelectric input device can be embedded in a flexible electrically functional fiber.

The foregoing description of example embodiments of the invention has been presented for the purposes of illustration and description. It is not intended to be exhaustive or to limit the invention to the precise forms disclosed. Many modifications and variations are possible in light of this disclosure. It is intended that the scope of the invention be limited not by this detailed description, but rather by the claims appended hereto.

What is claimed is:

1. A flexible electrically functional fiber comprising:

a core portion;

a first conductive layer surrounding the core portion;

a dielectric layer surrounding and in direct contact with the first conductive layer;

a functional layer also surrounding and in direct contact with the first conductive layer and abutted to the dielectric layer, such that the dielectric layer and the functional layer occupy different locations along a longitudinal length of the fiber;

a second conductive layer surrounding the dielectric layer and the functional layer; and an insulative layer surrounding the second conductive layer.

2. The functional fiber of claim 1, wherein the dielectric layer comprises a low-K dielectric material selected from the group consisting of porous silicon dioxide, silicon dioxide doped with fluorine, silicon dioxide doped with carbon, hydrogen silsesquioxane (HSQ), methyl silsesquioxane (MSQ), polyimide, polynorbornene, benzocyclobutene, PTFE, and cyclic carbosilane.

3. The functional fiber of claim 2, wherein the functional layer comprises a low-K dielectric material selected from the group consisting of porous silicon dioxide, silicon dioxide doped with fluorine, silicon dioxide doped with carbon, hydrogen silsesquioxane (HSQ), methyl silsesquioxane (MSQ), polyimide, polynorbornene, benzocyclobutene, PTFE, and cyclic carbosilane, with one or more functional materials embedded within the low-K dielectric material.

4. The functional fiber of claim 2, wherein the functional layer comprises a high-K dielectric material selected from the group consisting of hafnium oxide, hafnium silicon oxide, nitride hafnium silicate, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate.

5. The functional fiber of claim 2, wherein the functional layer comprises a piezoelectric material selected from the group consisting of polyvinylidene fluoride (PVDF), apatite, aluminum nitride, potassium sodium tartrate, lead zirconate titanate, zinc oxide composite, barium titanate, lithium tantalite, lanthanum gallium silicate, bismuth ferrite, lead scandium tantalate, and gallium phosphate.

6. The functional fiber of claim 2, wherein the functional layer comprises a piezoluminescent material selected from the group consisting of an alkali halide, a ferroelectric polymer, and quartz.

7. The functional fiber of claim 2, wherein the functional layer comprises at least one of a piezoelectric material and a piezoluminescent material and is configured such that a charge or current can be applied to the functional fiber to at least one of reset and reactivate the functional layer, providing for at least one of programming and un-programming of the functional fiber.

8. The functional fiber of claim 1, wherein the dielectric layer and the functional layer comprise the same dielectric material and the functional layer further includes a functional material.

9. The functional fiber of claim 1, wherein the dielectric layer and the functional layer comprise different dielectric materials.

10. The functional fiber of claim 1, wherein the core portion comprises at least one of a textile fiber, a liquid, and a gas.

11. The functional fiber of claim 1, wherein the core portion is at least partially hollow.

12. The functional fiber of claim 1, wherein at least one of the first and second conductive layers comprises at least one of tin-doped indium-oxide, aluminum-doped zinc-oxide (AZO), indium-doped cadmium-oxide, poly(3,4-ethylenedioxythiophene) (PEDOT), PEDOT with poly(styrene sulfonate) (PSS), and poly(4,4-dioctylcyclopentadithiophene).

13. The functional fiber of claim 1, wherein at least one of the first and second conductive layers has a resistance of less than $10^{-7}$ Ω·m.

14. The functional fiber of claim 1, wherein at least one of the first and second conductive layers has a resistance of less than $10^{-4}$ Ω·m.

15. The functional fiber of claim 1, wherein the insulative layer comprises at least one of polyethylene, polypropylene, polyvinylchloride, PTFE, rayon, nylon, acrylic, polyester, and aramid.

16. The functional fiber of claim 1, wherein the fiber includes a plurality of alternating first and second segments along the longitudinal length of the fiber, the first segments including the dielectric layer and the second segments including the functional layer.

17. The functional fiber of claim 16, wherein the first segments are of the same length as the second segments.

18. The functional fiber of claim 16, wherein the first segments are of different length from the second segments.

19. The functional fiber of claim 1, wherein each of the first conductive layer, dielectric layer, functional layer, second conductive layer, and insulative layer is less than 1 μm in thickness.

20. The functional fiber of claim 1, wherein each of the first conductive layer, dielectric layer, functional layer, second conductive layer, and insulative layer is less than 100 nm in thickness.

21. The functional fiber of claim 1, wherein the functional fiber has an average diameter of less than 5 μm.

22. The functional fiber of claim 1 further comprising a textile fiber twisted therewith.

23. A device comprising:

a functional fiber configured as in claim 1; and at least one of an input device, a power source, a memory cell, a communication channel, an interconnect, a capacitor, and an output device operably coupled with the functional fiber.

24. A twisted pair of functional fibers configured as in claim 1.

25. A woven or non-woven fabric comprising a functional fiber configured as in claim 1.

26. The fabric of claim 25, wherein the fabric is configured as a touch interface configured to communicate with a computing device.

27. A garment comprising the fabric of claim 25.

28. A crash test dummy comprising the fabric of claim 25.

29. A woven or non-woven fabric comprising:

a first functional fiber configured as in claim 1; and a second functional fiber configured as in claim 1, wherein the first and second functional fibers are oriented substantially perpendicular to one another.

30. The fabric of claim 29, wherein one of the first and second functional fibers is configured to carry at least one of current and a control signal.

31. The fabric of claim 29, wherein the fabric is configured to output at least one of an electromagnetic signal and an optomagnetic signal to a computing device communicatively coupled with the fabric.

32. An electrically functional fiber comprising:

a fiber core portion; and a plurality of layers surrounding the fiber core portion in a concentric arrangement, the plurality comprising:

a first conductive layer surrounding the fiber core portion;

a dielectric layer surrounding a first region of the first conductive layer along a length of the fiber;

a functional layer surrounding a second region of the first conductive layer along the length of the fiber, such that the dielectric layer and the functional layer occupy different locations along the length of the fiber and abut one another, wherein the functional layer comprises at least one of a dielectric material, a piezoelectric material, and a piezoluminescent material;

a second conductive layer surrounding the dielectric layer and the functional layer; and an insulative layer surrounding the second conductive layer;

wherein:

the functional fiber has an average diameter of less than 5 um; and at least one layer of the plurality is less than 1 μm in thickness.

* * * * *